US006041687A

United States Patent [19]

Fowler

[11] Patent Number: 6,041,687

[45] Date of Patent: Mar. 28, 2000

[54] AUTOMATED BULLET FEEDING MECHANISM FOR USE WITH A SHELL RELOADER

[76] Inventor: Malcolm Fowler, Rte. 2, Box 311-A, Angier, N.C. 27501

[21] Appl. No.: 09/073,173

[22] Filed: May 5, 1998

[51] Int. Cl.[7] ..... F42B 33/00; F42B 33/02

[52] U.S. Cl. ..... 86/45; 86/23

[58] Field of Search ..... 86/29, 31, 32, 86/33, 36, 37, 39, 40, 43, 44, 24, 23; 84/45; 42/16, 17; 89/33.03, 33.1, 33.14, 33.16, 33.17, 33.2, 33.25, 33.4, 33.5

[56] References Cited

U.S. PATENT DOCUMENTS

| | | | |
|---|---|---|---|
| 1,435,282 | 11/1922 | Declaye | 42/17 |
| 2,961,915 | 11/1960 | Salo | 86/25 |
| 3,421,408 | 1/1969 | Badali et al. | 89/33.1 |
| 3,610,090 | 10/1971 | Corcoran | 86/45 |
| 4,331,063 | 5/1982 | Schaenzer | 86/36 |
| 4,475,435 | 10/1984 | Mantel | 86/26 |
| 4,573,392 | 3/1986 | Mantel | 86/43 |
| 5,179,243 | 1/1993 | Schroeder | 86/25 |
| 5,313,869 | 5/1994 | Lee | 86/25 |
| 5,763,810 | 6/1998 | Lee | 86/45 |

*Primary Examiner*—Charles T. Jordan
*Assistant Examiner*—Jeffrey Howell
*Attorney, Agent, or Firm*—Coats & Bennett, P.L.L.C.

[57] ABSTRACT

An automatic bullet feeding mechanism is intended for use with a typical rifle or pistol cartridge reloading machine. More particularly, the bullet feeding mechanism of the present invention includes a generally cylindrical main housing which is adapted to be received within the main frame structure of the reloading machine. A reservoir attached to the upper end of the mechanism provides the main housing with a continuous supply of bullets. A pivoting lever arm, which includes a lower catch finger, is adapted to be received and mounted within a generally vertical groove formed in one side housing cylinder. Opposing the pivoting lever arm is an upper catch slide assembly which is movably mounted within a second generally vertical groove formed in the other side of the housing cylinder. A swiveling linkage, which passes around the exterior surface of the housing, connects the pivoting lever arm and an upper catch finger included in the upper catch slide assembly such that the relative motions of the upper and lower catch fingers are generally synchronized. Prior to actuation, the bullet to be loaded is generally supported by the lower catch finger, while the upper catch finger is completely withdrawn or retracted. With actuation of the pivoting lever arm, the lower catch finger is withdrawn such that the lowermost bullet is allowed to drop or fall past. As the lower catch finger is withdrawn, the upper catch finger is simultaneously inserted into the housing so as to generally catch and support the next bullet in the feed stack, thereby preventing the next bullet and necessarily all others above it from falling through and out of the housing in an uncontrolled manner. As actuation of the pivoting lever arm ceases, the lower catch finger is re-inserted into the housing while the upper catch finger is withdrawn. Consequently, the bullet being temporarily supported by the upper catch finger is allowed to drop downwardly until it reaches and is supported by the re-inserted lower catch finger.

21 Claims, 5 Drawing Sheets

AUTOMATED BULLET FEEDING MECHANISM FOR USE WITH A SHELL RELOADER

FIELD OF THE INVENTION

The present invention relates machines for use in the reloading of pistol or rifle ammunition and more particularly to a mechanism for automatically feeding and properly positioning a bullet type projectile within the open end of a shell casing.

BACKGROUND OF THE INVENTION

Mechanical devices for automating or semi-automating the process of reloading of spent pistol or rifle shell casings are well known and have been in wide use for many years. Such mechanical reloading devices typically execute a well defined sequence of operations including; de-priming of the spent shell casing, re-priming of the casing, measurement and insertion of gunpowder within the re-primed shell casing, and mechanically crimping or sealing of the upper end of the shell casing once a bullet has been seated therein. In general, each of these processing steps are accomplished at separate process stations which are housed within the reloading machine.

Most commercially available reloading machines require at least some degree of user interaction or actuation. That is, these machines are generally not fully automated and consequently require operator assistance or participation at various stages of the reloading process. Typically such operator participation involves actuation of a mechanical arm or lever which, through a variety of mechanical linkages, serves to move the shell casing through the various processing stations, and which in some cases may also initiate or actuate the processing step.

However, while many of the reloading processes mentioned above are accommodated or automated, at least in part, by the internal mechanisms of the reloading machine, the feeding and seating of a bullet within the primed and powdered shell casing is generally not. Typically, the operator is required to manually insert the bullet within the shell casing, taking care to insure that bullet is properly oriented, prior to the shell reaching the automated crimping station. Manual placement of the bullet within the shell casing is time consuming and consequently lowers the overall effective reloading rate that an operator can achieve, and furthermore the manual placement of bullets within the casing is a significant source of error which can further slow the reloading process.

Therefor there is and continues to be a need for a mechanism that functions integrally with a pistol or rifle shell reloading machine which serves to automate the process of feeding and seating bullets within the associated shell casings.

SUMMARY OF THE INVENTION

The present invention entails an automatic bullet feeding mechanism that is intended for use with a cartridge reloading machine that is typically used to reload rifle and pistol cartridges. The bullet feeding mechanism of the present invention includes a generally cylindrical main housing or bullet holding tube which is adapted to be mounted on the reloading machine. The bullet holding tube of the bullet feeding mechanism is adapted to hold a stack of bullets, one bullet over the other, and with the stack including a lowermost bullet and a bullet overlying the lowermost bullet. A first catch is mounted adjacent the bullet holding tube and projects through an opening in the bullet holding tube to engage and hold the lowermost bullet within that tube. A second catch is mounted adjacent the bullet holding tube and is operative to penetrated an opening in the bullet holding tube engage and hold the bullet overlying the lowermost bullet. An actuator is provided that simultaneously actuates both the first bullet catch and the second bullet catch. More particularly, the actuator is operative to withdraw the first catch, causing the lowermost bullet to drop from the bullet holding tube. At the same time the actuator is operative to move the second catch into engagement with the bullet overlying the lowermost bullet. The engagement of the second catch with the overlying bullet results in the overlying bullet being held within the bullet holding tube while the lowermost bullet is released in being dropped from the bullet feeding mechanism. After the lowermost bullet has been released and dropped, the first bullet catch is returned to its home position where it extends into and through a portion of the bullet holding tube. As the first bullet catch is returned to this position, the second bullet catch is released or withdrawn from the bullet holding tube, allowing the overlying bullet to fall down the bullet holding tube and to engage and rest upon the first bullet catch. This basic process is repeated and as a result of the repeating process, the automatic bullet feeding mechanism of the present invention is able to dispense one bullet at a time and in the case where the feeding mechanism is used in conjunction with a reloading machine, the bullets are dispensed into one or more cartridges.

In addition, the bullet feeding mechanism of the present invention is provided with one or more caliber adapted sleeves that can be mounted in the main housing or the bullet holding tube so as to give the bullet feeding mechanism the capability of handling various size bullets. Also, the bullet feeding mechanism of the present invention is provided with one or more caliber gauges that are also inserted, one at a time, in the bullet holding tube. Each caliber gauge, when inserted into the bullet holding tube, enables the operator to adjust the depth of penetration of a respective bullet catch.

It is therefor an object of the present invention to provide an automatic bullet feeding mechanism that will dispense one bullet at a time from a group or array of bullets.

Another object of the present invention is provide a bullet feeding mechanism that is capable of handling bullets of different calibers.

Another object of the present invention is to provide a bullet feeding mechanism that is capable of being incorporated into a cartridge reloading machine such that in the process of reloading cartridges held within the cartridge reloading machine, the automatic bullet feeding mechanism is operative to dispense bullets, one at a time, into empty cartridges held by the cartridge reloading machine.

Other objects and advantages of the present invention will become apparent and obvious from a study of the following description and the accompanying drawings which are merely illustrative of such invention.

DETAILED DESCRIPTION OF THE INVENTION

Figure 1:
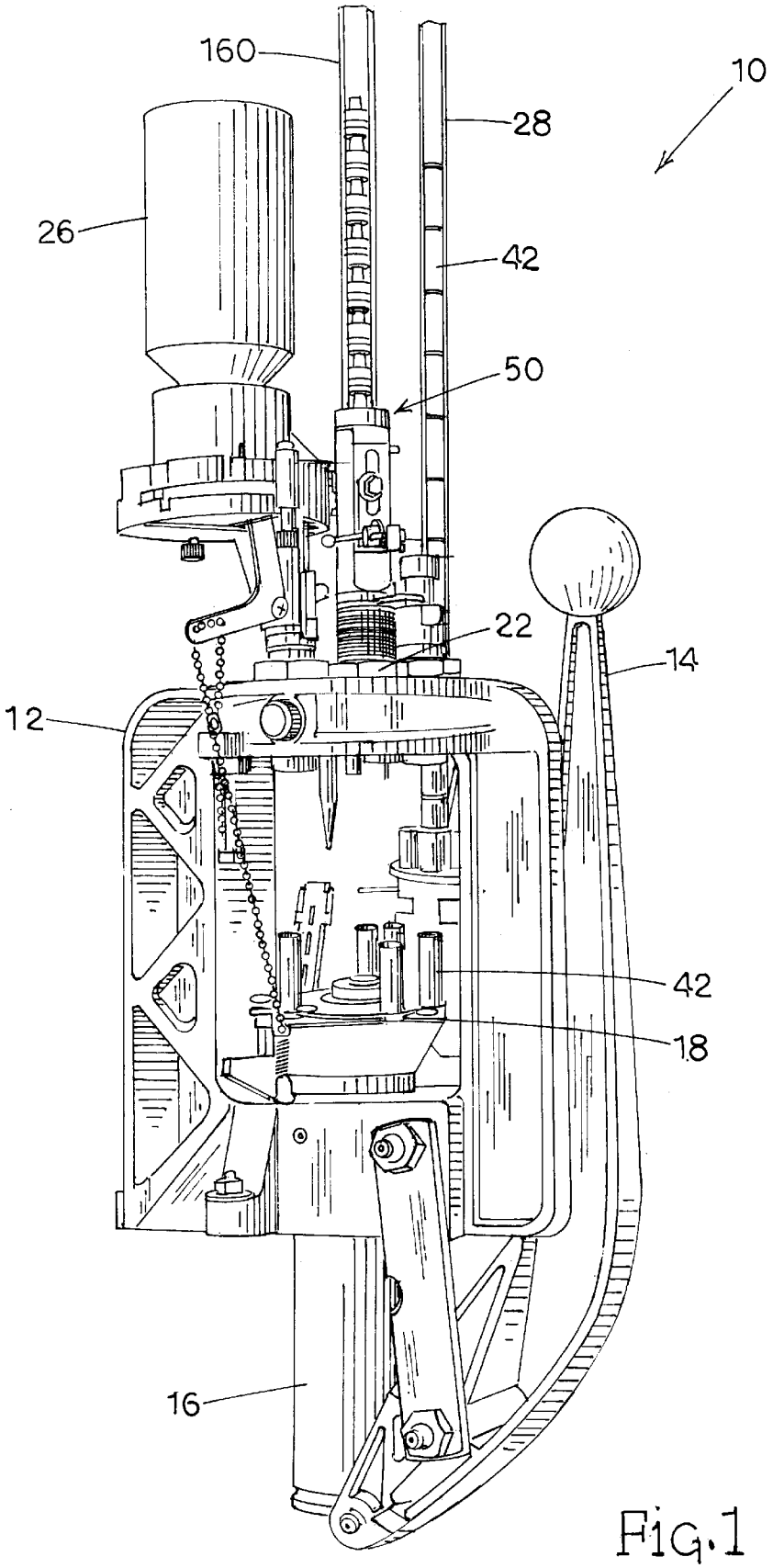
FIG. 1 is a side elevational view of a reloading machine which incorporates the automatic bullet feed mechanism of the present invention.

Shown in FIG. 1 is a perspective view of a typical rifle or pistol cartridge reloading machine, generally indicated by the numeral 10. Such cartridge reloading machines 10 typically include a supporting frame structure 12. Attached to the frame structure 12 is a hinged actuating lever arm 14, which is further connected to a movable, central pedestal 16. Disposed atop the pedestal 16 is a rotatably mounted working platform 18. Working platform 18 includes five seating grooves, which are each adapted to receive and secure a single cartridge casing 42. Positioned in the top of the frame structure 12 and generally above the working platform 18 is an upper die plate (not shown). This die plate includes a series of five apertures and adapter sleeves 22 fitted therein, where each penetration and associated adapter sleeve 22 correspond to a particular station or reloading operation. More particularly, the five reloading operations include; de-priming of the spent casing, re-priming of the casing, powdering, bullet seating, and crimping of the casing.

It will be appreciated that during normal operation the working platform 18 is rotated through each of the five distinct positions, with each position corresponding to a particular reloading station or operation. Also included in the die plate is a centrally located aperture which is adapted to receive a moveably mounted actuating rod 24. Each of the previously mentioned upper die plate apertures and associated adapter sleeves 22 is configured to receive and secure a particular instrument or tool that is associated with one of the reloading operations discussed above. For example, one die plate aperture and sleeve 22 is adapted to receive a gunpowder reservoir 26, while another aperture and sleeve 22 is adapted to receive a casing reservoir tube 28. Of particular interest is the die plate aperture and sleeve 22 that is adapted to secure a bullet feeding mechanism, generally indicated by the numeral 50, for use in the bullet seating operation. In the case of the adapter sleeve 22 that is used to secure the bullet feeding mechanism 50, it will be appreciated that a set screw (not shown) is employed to insure that the mechanism 50 remains stationary with the sleeve 22 at all times during normal operation. Furthermore, it should be appreciated that the actuating lever 14, when engaged or invoked, is responsible for initiating the various reloading operations at each of the stations described above, including the bullet feeding and seating operation provided by the bullet mechanism 50 via the actuating rod 24.

The above description generally describes the cartridge reloading machine 10 as particularly shown in FIG. 1. General details of the cartridge reloading machine 10 are not dealt with herein in depth because such is not per se material to the present invention, and because basic cartridge reloading technology is well known and understood by those skilled in the art. Further, cartridge reloading equipment of the general type shown in FIG. 1 and discussed above are commercially available and are manufactured by various manufacturers, including Lee, Inc.

Figure 4:
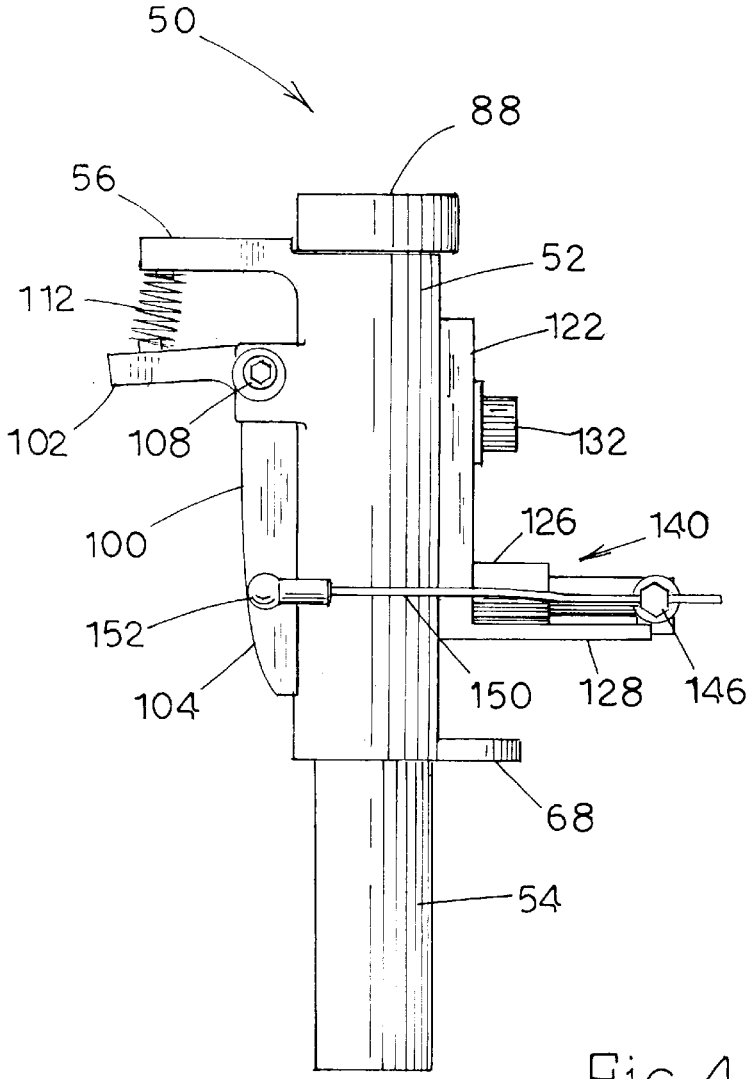
FIG. 4 is a side elevational view of the automatic bullet feed and placement mechanism of the present invention which illustrates the connecting linkage.
Figure 5:
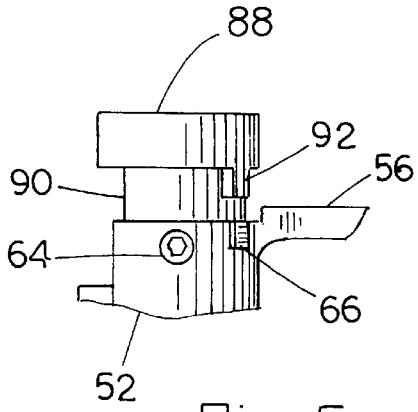
FIG. 5 is an fragmentary, exploded side elevational view of the automatic bullet feed and placement mechanism of the present invention which illustrates the placement of a caliber adapter sleeve.
Figure 6:
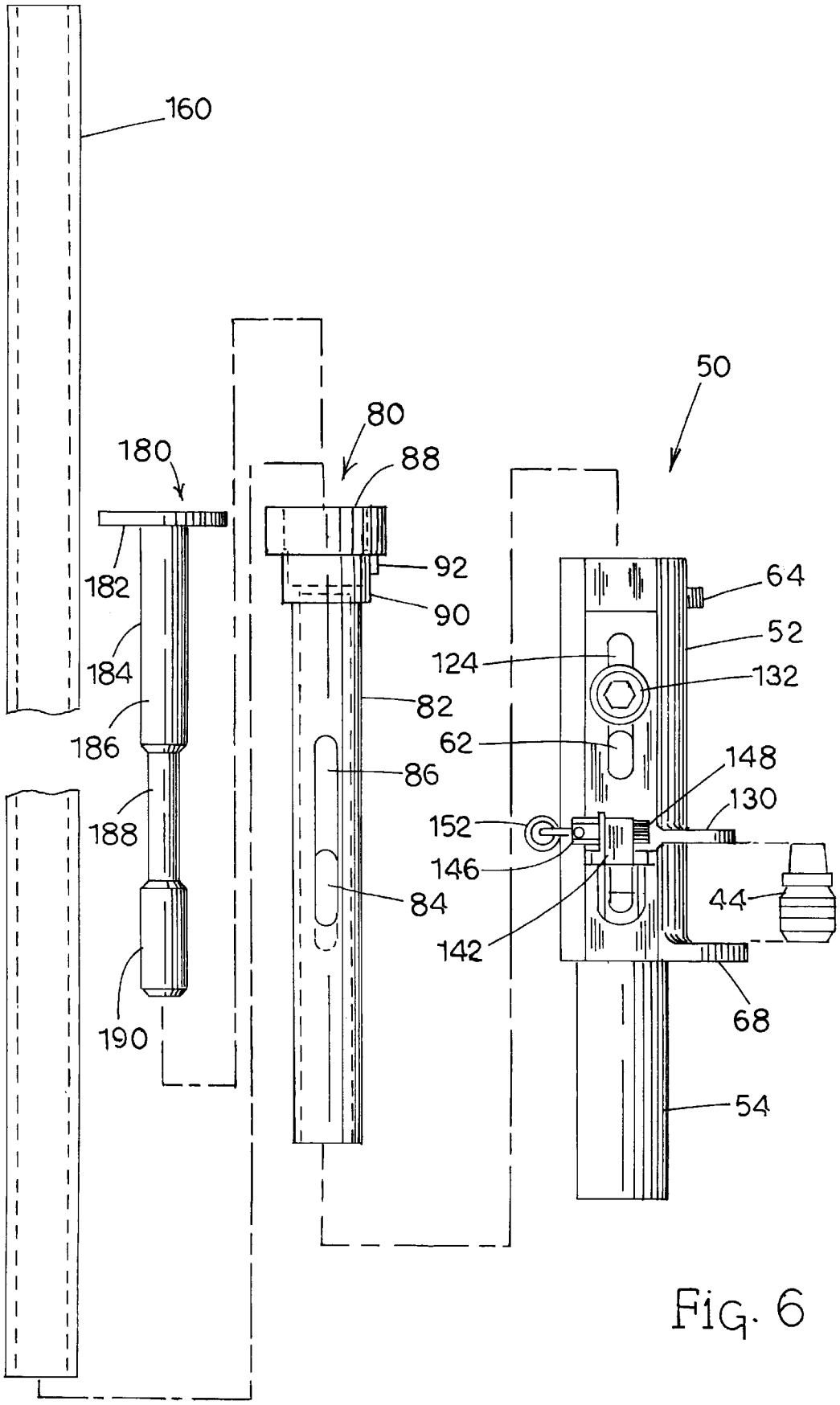
FIG. 6 is an exploded view of the automatic bullet feed and placement mechanism of the present invention which illustrates the relative positioning of a caliber adapter sleeve, calibration insert and bullet reservoir tube.

Of particular relevance to the present disclosure is the bullet feeding mechanism 50 which is shown in greater detail in FIGS. 2 through 6. Mechanism 50 is comprised of a generally cylindrical housing which includes an upper and a lower section 52 and 54, respectively, with the outside diameter of the upper section 52 being larger than that of the lower section 54. While the upper and lower housing sections 52 and 54, respectively, differ in outside diameter, both sections generally share a common inside diameter. More particularly, the top region of the upper housing section 52 has an inside diameter that is slightly larger than the inside diameter of the remainder of the housing. This slightly enlarged diameter allows the top region of the upper housing 52 to accommodate a bullet reservoir tube 160, as shown in FIG. 6. That is the bullet reservoir tube 160 has an outside diameter that is approximately equal to the slightly enlarged inside diameter of the top region of the upper housing section 52. It will be appreciated that in the preferred embodiment discussed and described herein, that the housing is fabricated of a metal or metal alloy such as iron or steel. Furthermore, the upper and lower cylindrical housing sections 52 and 54, respectively, are formed from a single, continuous length of metallic material via a conventional machining technique such as lathe processing.

Figure 3:
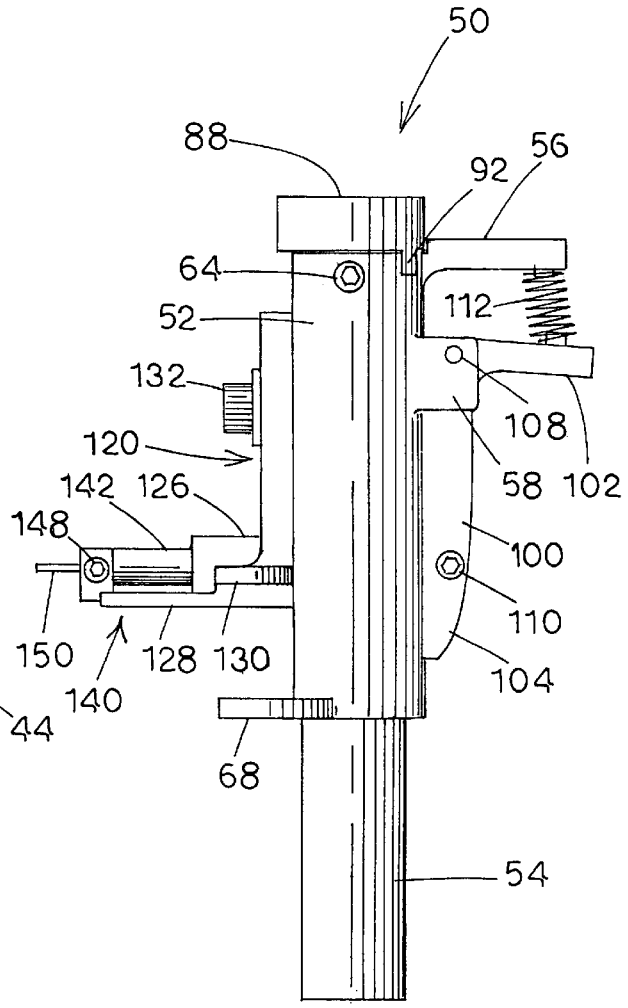
FIG. 3 is a side elevational view of the automatic bullet feed and placement mechanism of the present invention which illustrates the height adjustment pedestals.

The top surface of the upper section 52 includes a key way or keyed slot 66, while a threaded appeture and corresponding set screw 64 are also disposed in upper region of the upper housing section 52, as shown in FIG. 3. Although the upper and lower housing sections 52 and 54, respectively, are generally cylindrical in shape as described above, the upper section 52 further includes a vertically oriented, elongated flat region which generally spans the entire vertical length of the upper housing section 52.

Attached to the lower end of the upper section 52 is a lower tab or pedestal 68 which extends radially outward and away from the exterior surface of the housing. In the preferred embodiment, this pedestal 68 is permanently and immovably affixed to the upper section 52 via a welding or similar type fabrication process. Also attached to the upper section 52 is a spring stop tab 56 which extends radially outward and away from the exterior surface of the housing, in a manner similar to that described above for the pedestal 68. Furthermore, the spring stop tab 56 is also permanently and immovably affixed to the upper region of the upper section 52 via a welding or similar type fabrication process. Attached to the upper housing section 52, adjacent and just below the spring stop tab 56 is a pair of spaced apart hinge tabs 58. Each hinge tab 58 includes an appeture, such that a generally cylindrical hinge pin 108 may be received by and secured within the two adjacent tabs. Once again, the tabs 58 are permanently and immovably affixed to the upper region of the upper section 52.

Figure 9:
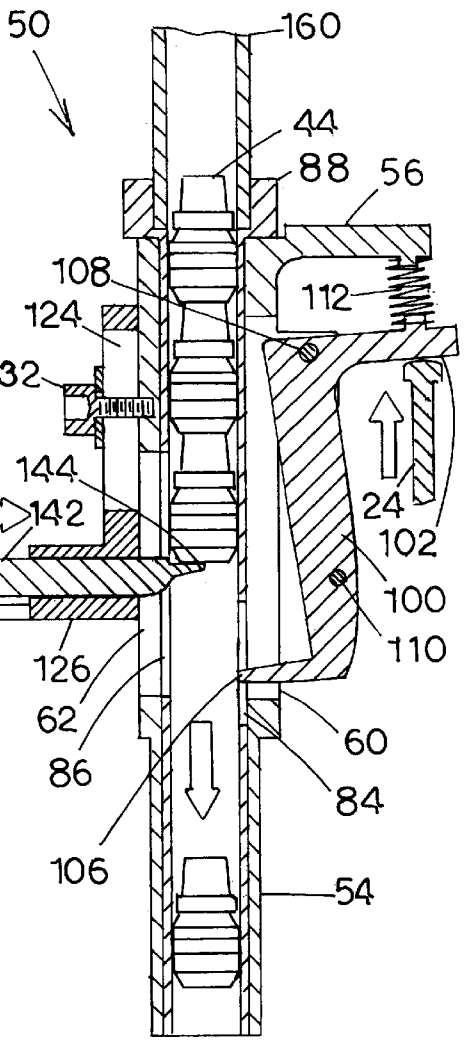
FIG. 9 is a schematic, sectioned side elevational view of the bullet feeding mechanism of the present invention in a fully actuated state.
Figure 8:
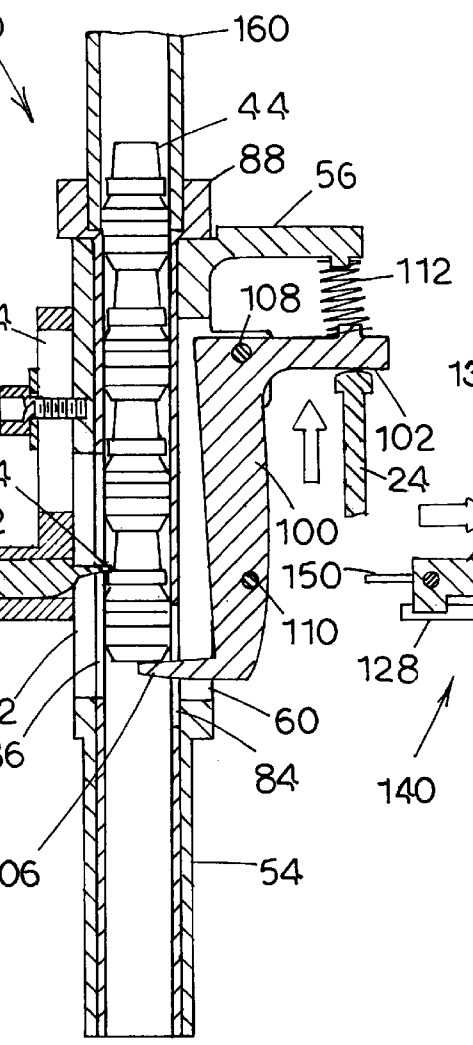
FIG. 8 is a schematic, sectioned side elevational view of the bullet feeding mechanism of the present invention in an intermediate state of actuation.
Figure 7:
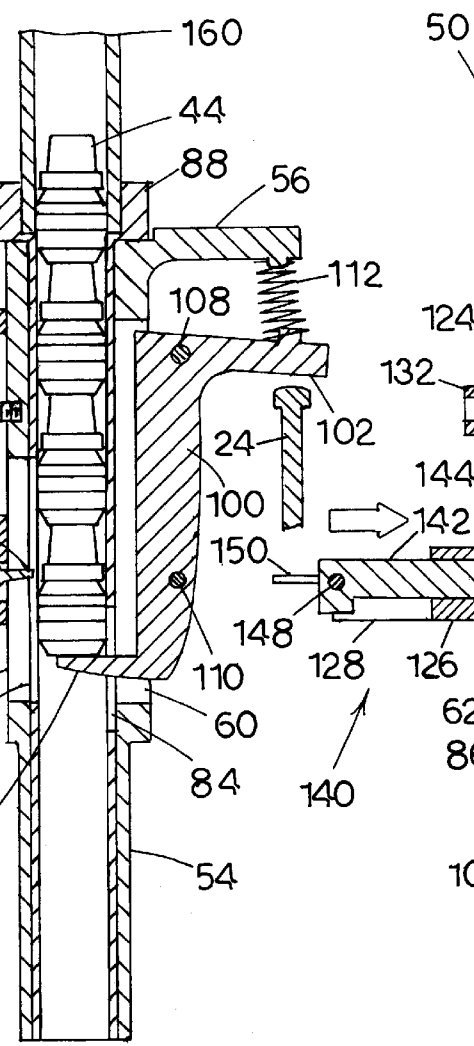
FIG. 7 is a schematic, sectioned side elevational view of the bullet feeding mechanism of the present invention in a non-actuated state.

Disposed in the upper housing section 52 is a first elongated slot or groove 60 which is vertically oriented and extends from just below the upper spring stop 56 downwardly and towards the lower housing section 54, as shown in FIGS. 7 through 9. As such, the groove 60 completely penetrates the wall of the upper housing section 52 and passes between the pair of spaced apart hinge tabs 58. Also disposed in the wall of the upper housing section 52, in a position that diametrically opposes the groove 60, is a second vertically oriented, elongated slot or groove 62. Groove 62 is located in and generally coincident with the vertically oriented, elongated flat region of the upper housing section 52, but does not extend over the entire length of the upper section 52. Also disposed in the flat region, generally above the groove 62 is a threaded bolt appeture, which is adapted to receive and secure an associated bolt 132.

Figure 2:
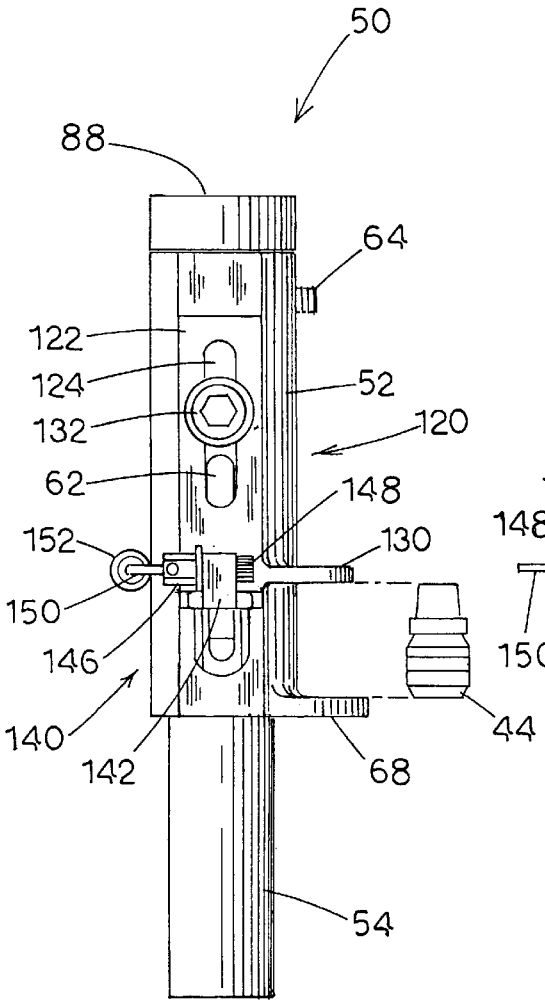
FIG. 2 is a front elevational view of the automatic bullet feed and placement mechanism of the present invention.

Adapted to be received by and mate with the flat region of the upper housing section 52 is a slide assembly, generally indicated by the numeral 120 as shown in FIGS. 2 and 3. Slide assembly 120 includes a mounting plate 122 which is adapted to be received by the flat region on the upper housing section 52. Mounting plate 122 further includes a vertically oriented, elongated groove or slot 124 through which the bolt 132 extends and generally secures the slide assembly 120 to the upper housing section 52. The lower end of the slide assembly 120 includes an upper catch appeture 126, which assumes the form of a hollow cylinder that extends generally outwardly away from the surface of the upper housing section 52. Disposed adjacent and below the upper catch appeture 126 is a generally fork shaped projection that includes a pair of guide rails 128, which also extend outward and away from the surface of the upper housing section 52. Extending generally outwardly from the side of the guide rail structure 128 is an upper tab or pedestal 130. When the slide assembly 120 is properly secured to the upper housing section 52, the upper pedestal 130 is disposed so as to be generally above and aligned with the adjacent lower pedestal 68, as shown in FIGS. 2 and 6. Furthermore, as the slide assembly 120 is movably mounted to the upper housing section 52 via the groove 124 and securing bolt 132, the distance or separation between the upper and lower pedestals 130 and 68, respectively, may be varied as desired.

As shown in FIGS. 3 and 4, pivotally mounted to the upper housing section 52 via the hinge tabs 58 and an associated securing pin 108 is an actuating lever 100. Actuating lever 100 further includes an actuating tab 102 that extends generally outwardly and away from the housing wall and which is disposed adjacent and below the upper spring stop 56. Extending generally vertically downward from the base of tab 102 is a lever arm 104 which also includes a connecting pin 110. Projecting from the lower end of the arm 104, generally inward and through the groove 60, is a lower catch finger 106, as shown in FIGS. 7 through 9. A helical type compression spring 112 is adapted to be received and secured between the upper stop 56 and the tab 102, such that the spring 112 provides a biasing force which urges the actuating tab 102 generally downward and away from the upper stop 56. As such, actuating lever 100 is generally seated within and extends at least partially through the elongated groove 60. More particularly, when not actuated the lower catch finger 106 extends completely through the groove 60 and significantly into the interior of the upper housing section 52. Actuation of the tab 102 effectively compresses the spring 112 against the upper stop 56 and causes the lever 100 to pivot about the pin 108, ultimately resulting in the withdrawal of the catch finger 106 from the interior of the upper housing section 52.

Associated with both the slide assembly 120 and the actuating lever 100 is an upper catch assembly, generally indicated by the numeral 140. Upper catch assembly 140 includes a catch rod 142, the body of which is shaped so as to be movably or slidingly received within the adjacent upper catch appeture 126, as shown in FIGS. 7 through 9. The end of the catch rod 142 which is disposed to be inserted within the interior of the upper housing section 52 includes a narrowed tip or catch finger 144 that is used to engage and restrain the bullets 44 contained or stacked therein. The other end of the catch rod 142 is configured so as to receive a connecting pin 148 which is adapted to secure the catch rod 142 to an adjustable and swiveling linkage connector 146. Additionally connecting pin 148 serves to secure the linkage connector 146 to an associated linkage rod 150, and furthermore pin 148 is also used to facilitate adjustment of the linkage connector 146 which ultimately affects the depth to which the catch finger 144 is extended into the upper housing section 52 during normal actuation. The remaining end of the linkage rod 150 extends around the outside of the upper housing section 52 and is received and secured by a swiveling connector 152, which is itself further secured to the arm 104 of the actuating lever 100 via the pin 110, as indicated in FIG. 4. It will be appreciated that as the slide assembly 120 is moved up and down vertically on the upper housing 52, the angle formed between the two linkage connecting pins 148 and 154 will necessarily be altered, hence the need for a swiveling-type connectors. As such, actuation of the tab 102 affects the depth of insertion of both the upper and lower catch fingers 144 and 106, respectively via the pivoting action of the lever arm 104 and the connecting linkage 150.

The bullet feeding mechanism 50 of the present invention may also include a series of optional caliber adapter sleeve, generally indicated by the numeral 80 and shown in FIG. 6. In general, such adapter sleeve inserts 80 provide a means by which the bullet feeding mechanism 50 may accommodate bullets of varying calibers. The generally cylindrical adapter sleeve 80 includes a central region 82 which has an outside diameter that is approximately equal to the inside diameter of the upper and lower housing sections 52 and 54, respectively. The inside diameter of the sleeve central region 82 corresponds to the approximate diameter or caliber of the bullet that is to be loaded. Thus, all adapter sleeves 80 will necessarily have the same outside diameter, but may have differing inside diameters corresponding to different bullet calibers. As once again shown in FIG. 6, the top of the generally cylindrical insert sleeve 80 contains a head region 88 with an outside diameter that is approximately equal to the outside diameter of the upper housing section 52. The inside diameter of the head region 88 is approximately equal to the outside diameter of the bullet reservoir tube 160. Located adjacent and below the head region 88, on the outer surface of the insert sleeve 80 is a step down region 90 which has an outside diameter corresponding to the outside diameter of the bullet reservoir tube 160. As such, the step down region 90 of the insert sleeve 80 fits snugly into the enlarged diameter region in the top of the upper housing section 52 which, in the absence of an adapter sleeve 80, is intended to receive the bullet reservoir tube 160. Also disposed within the head region 88 of the adapter sleeve 80 is a locking key 92, which is adapted to mate with the keyed slot 66 formed in the wall of the upper housing 52.

Sleeve 80 also includes an actuating lever groove 84, which corresponds to groove 60 that is formed in the upper housing section 52. Furthermore, sleeve 80 includes an upper catch groove 86, which corresponds to groove 124 that is formed in the upper housing section 52. By inserting the generally cylindrical adapter sleeve 80 into the housing and insuring that the key 92 engages the key slot 66, proper coincidental alignment of the grooves 84 and 86 with their corresponding counterparts in the upper housing 52 is guaranteed.

Also shown in FIG. 6 is a calibration insert gauge, generally indicated by the numeral 180, that is used to set the depth of penetration or insertion of the upper catch finger 144 into the interior of the housing upper section 52. Calibration gauge 180 includes a large diameter, generally cylindrical head region 182, where the diameter of this head region 182 is typically greater than the outside diameter of the upper housing section 52. Extending downwardly and away from the head region 182 is an elongated, generally cylindrical shaft 184. In the embodiment described herein, the shaft 184 includes three regions; an upper region 186, a middle region 188, and a lower region 190. In general, the upper and lower regions 186 and 190, respectively, have a common diameter that corresponds to the caliber of the bullet that is to be loaded. The middle region 188, however, has a diameter that is slightly smaller than the caliber of the bullet that is to be loaded. Once again, it should be appreciated that the calibration insert gauge 180 is employed only during the initial setup of the bullet feeding mechanism 50 to set the depth of penetration or insertion of the upper catch finger 144. More particularly, it is the diameter of the middle region 188 of the calibration gauge 180 that determines the depth of insertion of the upper catch finger 144. The actual procedure for setting the insertion depth of the upper catch finger 144 will be described later in this disclosure.

As mentioned previously, general details of the operation of the cartridge reloading machine 10 are not dealt with herein in depth because such is not per se material to the present invention, and because basic cartridge reloading operations are well known and understood by those skilled in the art. Consequently, only the significant operational details of the bullet feeding mechanism 50 of the present invention will be discussed below.

Operation of the bullet feeding mechanism 50, as described above, first requires the operator to choose or select the caliber of the cartridge that is to be reloaded. For the purposes of illustration, it will be assumed herein that a caliber adapter sleeve 80 is required. If the chosen caliber is smaller than the inside diameter or caliber of the upper housing 52, then an appropriate caliber adapter sleeve 80 must be selected and employed. As shown in FIG. 5, the adapter sleeve 80 is inserted into the open top of the upper housing section 52, such that the key tab 92 is aligned with and engages the corresponding key slot 66 formed in the wall of the upper housing 52. However, it will be appreciated that prior to insertion and seating of the sleeve 80 within the housing, the connecting linkage 150 must be effectively released from the catch rod connector 146 so that the catch rod 142 and the associated catch finger 144 may be withdrawn from the interior of the upper housing 52. Once the catch rod 142 has been withdrawn, the sleeve 80 may be inserted into the interior of the upper housing 52 while the lever arm actuating tab 102 is simultaneously forced upwards and towards the upper spring stop 56. Actuation of the lever arm tab 102 causes the lower catch finger 106 to be effectively withdrawn from the interior of the upper housing 52, thus allowing the sleeve 80 to pass therethrough and be properly seated therein. Being so inserted and seated within the housing, the adapter sleeve grooves 84 and 86 are necessarily aligned with the corresponding groove pair 60 and 62, respectively, in the upper housing section 52. Following the insertion and seating of the sleeve 80, both the upper and lower catch fingers 144 and 106, respectively, are returned to their normal resting positions and the set screw 64 is tightened so as to generally secure the sleeve 80 within the upper housing 52.

With the proper caliber adapter sleeve 80 installed, the vertical separation of the upper and lower catch fingers 144 and 106, respectively, is next set using a single bullet 44 and the upper and lower pedestals 130 and 68, respectively, as shown in FIGS. 2 and 6. Recalling that the position of the lower pedestal 68 is fixed with respect to the lower catch finger 106, and that the position of the upper pedestal 130 is fixed with respect to the slide assembly 120 and consequently the upper catch finger 144, it follows that altering the position of the movable slide assembly 120 and associated upper pedestal 130 with respect to the lower pedestal 68 will proportionally alter the separation distance of the upper and lower catch fingers. The adjustment or setting of the catch finger separation is accomplished by first loosening the securing bolt 132 so that the slide assembly 120 is free to move vertically along the upper catch groove 62. The sample bullet 44 is then placed upon the lower pedestal 68, while the slide assembly 120 and the associated upper pedestal 130 are allowed to slide generally downwardly until the lower face of the pedestal 130 comes to rest on the top of the bullet 44. The bolt 132 is then re-tightened, thus securing the slide assembly 120 and fixing the separation distance between the upper and lower catch fingers 144 and 106, respectively.

The final initialization or setup step involves the insertion of the calibration gauge 180 into the interior of the upper housing 52 so that the depth of extension or insertion of the upper catch finger 144 into the housing interior may be established, as indicated in FIG. 6. First, the adjustable linkage connector 146 is loosened via the pin 148 such that the associated connecting linkage is free to move independently of the catch rod 142. With the gauge fully inserted, the actuating tab 102 is then forced upward until the tip of the associated lower catch finger 106 is withdrawn into and generally flush with the interior wall of the upper housing 52. While the tip of the lower catch finger 106 is maintained flush with the interior wall of the upper housing 52, the catch rod 142 is forced inward towards the interior of the upper housing 52 until the tip of the associated upper catch finger 144 contacts the middle region 188 of the adjacent calibration gauge 180. The adjustable linkage connector 146 is then re-tightened via the pin 148 such that the desired upper catch finger penetration depth is fixed.

It will be appreciated that any changes in the bullet caliber, bullet height, or other aspects of the bullet geometry may require the setup steps described above to be repeated prior to the initiation or continuation of reloading operations.

Shown in FIGS. 7 through 9 is a sequence of illustrations which depict, schematically, the fundamental operating principles of the bullet feeding mechanism 50. As indicated in the first illustration, FIG. 7, bullet reservoir tube 160 provides a series of individual bullets 44 to the interior of the upper housing 52. It will be appreciated that the bullets 44 have been loaded into the reservoir tube 160 in a consistent and upright orientation. The lowermost bullet 44 in the feed stack is resting on and supported by the lower catch finger 106, which is biased towards a fully inserted position by the associated actuating lever 100 and spring 112. In general, the remaining bullets in the feed stack rest on and are supported by the top surface of the bullet immediately below. It will also be appreciated that while the lower catch finger 106 is fully inserted and supporting the adjacent bullet 44, the upper catch finger 144 is fully withdrawn or removed from the interior of the upper housing 52 and hence does not contact or interact with the adjacent bullet 44.

As the actuating lever 14 of the reloading machine 10 is pulled generally downwardly by the operator, the actuating rod 24 is driven upwardly and into engagement with the actuating tab 102 of the bullet feeding mechanism 50. Once engaged, actuating rod 24 generally forces tab 102 upwards so as to oppose the biasing force provided by the spring 112. It will be appreciated that the effect of the engagement of the actuating rod 24 is shown schematically in FIGS. 7–9, as indicated by the vertically oriented and upwardly pointing arrows.

In any case, as the actuating tab 102 is forced upwardly, the body of the actuating lever 100 is pivoted about the hinge pin 108 in such a manner that the lever arm is moved generally outwardly through the groove 60 and away from the upper housing 52, as shown in FIG. 8. Consequently, the lower catch finger 106 is also moved generally outwardly through the grooves 60 and 84 formed in the upper housing 52 and adapter sleeve 80, respectively. As the lower catch finger 106 is withdrawn from the interior of the housing 52, the surface area of the finger 106 that remains in contact with and supports the adjacent bullet 44 becomes increasingly smaller. Simultaneous with the withdrawal of the lower catch finger 106 from the interior of housing 52, the upper catch finger 144 is urged or pulled inward and generally through the grooves 62 and 86 formed in the upper housing 52 and adapter sleeve 80, respectively. The inward pulling or insertion of the upper catch finger 144 into the interior of the housing 52 is accomplished via the connecting linkage 150 which is attached at one end to the pivoting lever arm 104 and at the other end to the catch rod 142. Thus, as the lever arm 104 is pivoted generally outward and away from the housing 52, the connecting linkage 150 exerts a net force on the associated catch rod 142 which causes the rod to move along the guide rails 128 inward and towards the interior of the housing as indicated by the arrow in FIG. 8. It will be appreciated that proper calibration of the upper catch finger penetration depth, as described above, insures that the inwardly moving upper catch finger 144 moves in proper synchrony with outwardly moving lower catch finger 106. Such synchronized movement further insures that the inwardly moving upper catch finger 144 does not strike or contact the side of the adjacent bullet 44 and cause the mechanism to bind.

With the tab 102 fully actuated, the associated lever arm 104 is pivoted maximally outward and the lower catch finger 106 is withdrawn completely from the interior of the housing 52, as shown in FIG. 9. Upon complete withdrawal of the lower catch finger 106 from the interior of the housing 52, the bullet 44 formerly resting on and supported by the finger 106 is free to drop downwardly through the lower housing 54 into an awaiting shell casing positioned below (not shown). Simultaneous with the dropping or release of the bullet 44 from the lower catch finger 106, the upper catch finger 144 is drawn into the interior of the housing 52 so as to catch and support the bottom of the next bullet in the stack, thus preventing this bullet and all others above it in the reservoir from passing freely through and ultimately out of the interior passageway. Once again, it is the synchronized movement of the upper and lower catches 144 and 106, respectively, via the connecting linkage 150 which insures that as the lower most bullet is released, the next bullet above will be caught and restrained by the upper catch 144 until the lower catch 106 is returned to the neutral or non-actuated position. As the force applied to the actuating tab 102 is removed, the spring 112 is allowed to return the lever arm 104 and associated lower catch 106 back to a neutral or normally inserted configuration similar to that illustrated in FIG. 7. Once again, as a consequence of the connecting linkage 150, it follows that the upper catch finger 144 will also return to a neutral or normally withdrawn position as the force on the actuating tab 102 is removed. As the upper catch finger 144 is withdrawn and returns to a neutral position, the bullet temporarily supported by the finger 144 is allowed to drop downward until contact is made with the re-positioned lower catch finger 106. At this point the feeding mechanism 50 has effectively completed one cycle of operation, with the next bullet in the reservoir being in position for loading.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An automatic bullet feeding mechanism for feeding one bullet at a time, comprising:

a. a bullet guide sleeve for receiving and holding a stack of bullets, one over the other;

b. a lower finger catch mounted adjacent the bullet guide sleeve and movably mounted for movement back and forth between an engaged position with a lowermost bullet of the bullet stack and a disengaged position;

c. in the engaged position the lower finger catch extending through an opening in the bullet guide sleeve and engaging and supporting the lowermost bullet, and in the disengaged position the lower finger catch is sufficiently retracted from the bullet guide sleeve to enable the lowermost bullet to fall past the lower finger catch;

d. an upper finger catch disposed adjacent the bullet guide sleeve for selectively engaging and holding a bullet disposed above the lowermost bullet of the bullet stack when the lower finger catch assumes the disengage position;

e. an interconnecting linkage operatively interconnecting the lower finger catch with the upper finger catch for moving the two finger catches in unison such that as the lower finger catch is moved from the engaged position towards the disengaged position the upper finger catch is moved towards the engaged position; and f. wherein the upper and lower catches are disposed on opposite sides of the bullet guide sleeve, and wherein the interconnecting linkage extends across one side of the bullet guide sleeve.

2. The automatic bullet feeding mechanism of claim 1 wherein one of the finger catches forms a part of an actuator that is pivotally mounted about a transverse axis that lies exterior of the bullet guide sleeve.

3. The automatic bullet feeding mechanism of claim 2 wherein the actuator is spring biased such that the finger catch associated therewith is normally biased towards an engaged position.

4. The automatic bullet feeding mechanism of claim 3 wherein the actuator includes a tab that is adapted to be engaged by an actuating mechanism that moves back and forth for engagement with the tab.

5. The automatic bullet feeding mechanism of claim 1 wherein the bullet guide sleeve is adapted to accommodate a certain caliber bullet and wherein there is provided at least one insert adapter sleeve that is adapted to fit within the bullet guide sleeve such that the automatic bullet feeding mechanism has a capability of handling different caliber bullets.

6. The automatic bullet feeding mechanism of claim 5 wherein both the bullet guide sleeve and the insert adapter sleeve include openings formed therein to accommodate the movement of the upper and lower catch fingers.

7. The automatic bullet feeding mechanism of claim 6 including at least one catch depth calibration insert adapted to be mounted into either the bullet guide sleeve or an insert adapter sleeve for setting the depth of penetration of one of the catch fingers.

8. The automatic bullet feeding mechanism of claim 1 wherein the bullet feeding mechanism is incorporated into a cartridge reloading machine.

9. A bullet feeding mechanism for dispensing one bullet at a time from a vertical stack of bullets comprising:

a. a bullet holding tube for receiving and holding a stack of bullets including a lowermost bullet and a bullet overlying the lowermost bullet;

b. first and second openings formed in the bullet holding tube;

c. a first bullet catch mounted adjacent the bullet holding tube for engaging the lowermost bullet and holding the lowermost bullet in the bullet holding tube;

d. the first bullet catch being movable back and forth through the first opening formed in the bullet holding tube between an engaged position where it engages and holds the lowermost bullet in the bullet holding tube and a disengaged position which allows the lowermost bullet to be release from the first bullet catch and to drop through the bullet holding tube;

e. a second bullet catch mounted adjacent the bullet holding tube for engaging the bullet overlying the lowermost bullet and holding the overlying bullet within the bullet holding tube while the lowermost bullet is being released;

f. the second bullet catch being movable back and forth through the second opening in the bullet holding tube between an engaged position where it engages and holds the bullet overlying the lowermost bullet in the bullet holding tube and a disengaged position which allows the bullet overlying the lowermost bullet to drop to a position within the bullet holding tube where it becomes the lower most bullet and is held in the bullet holding tube by the first bullet catch;

g. an actuator for simultaneously actuating the first and second bullet catches and moving the first bullet catch from the engaged position to the disengaged position while moving the second bullet catch from the disengaged position towards the engaged position; and h. at least one depth calibration insert that is adapted to be inserted into the bullet holding tube for the purpose of setting the depth of penetration of a respective bullet catch.

10. The bullet feeding mechanism of claim 9 wherein the actuator includes a linkage interconnecting the first and second bullet catches.

11. The bullet feeding mechanism of claim 10 wherein the actuator includes a member that is repeatedly engaged and wherein the repeated engagement of the member causes the bullet feeding mechanism to be cycled.

12. The bullet feeding mechanism of claim 9 including at least one caliber adapter sleeve adapted to be inserted into the bullet holding tube so as to give the bullet feeding mechanism the capability of handling bullets of different calibers.

13. A method of feeding one bullet at a time from a bullet holding tube having a stack of bullets contained therein and including a lowermost bullet and a bullet overlying the lowermost bullet, comprising:

a. inserting a first catch into the bullet holding tube and engaging the lowermost bullet and holding the same in the bullet holding tube;

b. withdrawing the first catch from the bullet holding tube and releasing the lowermost bullet and allowing the same to fall;

c. inserting a second catch into the bullet holding tube and engaging the bullet overlying the lowermost bullet and holding the bullet while the lowermost bullet is allowed to drop;

d. inserting the first bullet catch into the bullet holding tube such that it assumes a position generally underneath the overlying bullet held by the second catch;

e. withdrawing the second catch from engagement with the bullet formerly overlying the lowermost bullet and releasing the formerly overlying bullet and allowing it to drop in the bullet holding tube to where it is held by the first bullet catch such that the bullet formerly overlying the lowermost bullet now assumes the lowermost bullet in the stack of bullets contained within the bullet holding tube; and f. inserting a depth calibration insert into the bullet holding tube and setting the depth that a particular bullet catch will penetrate into the bullet holding tube.

14. The method of claim 13 including inserting one or more caliber adapter sleeves into the bullet holding tube so as to enable bullets of different calibers to be dispensed.

15. The method of claim 13 including dispensing one bullet at a time from the bullet holding tube into a cartridge.

16. The method of claim 15 including rotating a series of cartridges underneath a lower end of the bullet holding tube and dispensing one bullet at a time from the bullet holding tube into the respective cartridges passing thereunder.

17. The method of claim 16 wherein the respective cartridges are carried by a cartridge reloading machine and wherein there is provided a bullet feeding mechanism disposed on the cartridge reloading machine for dispensing one bullet at a time into respective cartridges passing underneath the bullet holding tube.

18. The method of claim 13 wherein at least one of the bullet catches is movable with respect to the bullet holding tube such that bullets of different length can be dispensed according to the defined method.

19. The method of claim 13 wherein the two bullet catches are interconnected by a connecting linkage such that the actuation of one catch results in the movement of the other catch.

20. An automatic bullet feeding mechanism for feeding one bullet at a time, comprising:

a. a bullet guide sleeve for receiving and holding a stack of bullets, one over the other;

b. a lower finger catch mounted adjacent the bullet guide sleeve and movably mounted for movement back and forth between an engaged position with a lowermost bullet of the bullet stack and a disengaged position;

c. in the engaged position the lower finger catch extending through an opening in the bullet guide sleeve and engaging and supporting the lowermost bullet, and in the disengaged position the lower finger catch is sufficiently retracted from the bullet guide sleeve to enable the lowermost bullet to fall past the lower finger catch;

d. an upper finger catch disposed adjacent the bullet guide sleeve for selectively engaging and holding a bullet disposed above the lowermost bullet of the bullet stack when the lower finger catch assumes the disengage position;

e. an interconnecting linkage operatively interconnecting the lower finger catch with the upper finger catch for moving the two finger catches in unison such that as the lower finger catch is moved from the engaged position towards the disengaged position the upper finger catch is moved towards the engaged position; and f. an adjustable slide having one of the finger catches mounted thereon such that the distance between the upper and lower finger catches can be adjusted by adjusting the position of the slide thereby enabling the bullet feeded mechanism to accommodate bullets of different lengths.

21. The automatic bullet feeding mechanism of claim 20 including a pair of bullet height measuring tabs one tab being fixed relative to the bullet guide sleeve and the other tab being mounted to the slide.

* * * * *